United States Patent [19]

Louvaris

[11] Patent Number: 5,022,102

[45] Date of Patent: Jun. 11, 1991

[54] INFLATABLE BATHING DEVICES

[76] Inventor: Maria Louvaris, 241 Hillandale Ct., Bloomingdale, Ill. 60108

[21] Appl. No.: 534,032

[22] Filed: Jun. 6, 1990

Related U.S. Application Data

[63] Continuation-in-part of Ser. No. 357,018, May 24, 1989, abandoned.

[51] Int. Cl.[5] ..... A45D 19/06; A47K 3/64

[52] U.S. Cl. ..... 4/516; 4/517; 4/519; 4/585; 4/588; 4/518; 4/567; 4/553; 4/546

[58] Field of Search ..... 4/516-521, 4/559, 584, 585, 588, 546, 567, 553, 554, 572

[56] References Cited

U.S. PATENT DOCUMENTS

| | | | |
|---|---|---|---|
| 121,921 | 12/1871 | Winn | 4/521 |
| 367,157 | 7/1887 | Nonotnick | 4/521 |
| 573,625 | 12/1896 | Ruffner | 4/588 |
| 717,148 | 12/1902 | Walters | 4/521 |
| 772,763 | 10/1904 | Walters | 4/521 |
| 1,825,188 | 9/1931 | Janmusz | 4/553 |
| 2,434,279 | 1/1948 | McDonough et al. | 4/518 |
| 2,471,302 | 5/1949 | Boward | 4/588 |
| 2,504,646 | 4/1950 | Burrow | 4/588 |
| 2,547,810 | 4/1951 | Burgess | 4/521 |
| 2,548,301 | 4/1951 | Gibson | 4/553 |
| 2,564,190 | 8/1951 | Danelson | 4/584 |
| 2,600,392 | 6/1952 | Cancell | 4/521 |
| 3,058,122 | 10/1962 | McDaniel et al. | 4/588 |
| 3,292,186 | 12/1966 | Turmenne | 4/519 |
| 3,854,148 | 12/1974 | LaRose | 4/519 |
| 4,068,326 | 1/1978 | Deschler | 4/588 |
| 4,074,369 | 2/1978 | Harmon | 4/518 |
| 4,547,919 | 10/1985 | Wong | 4/499 |
| 4,935,971 | 6/1990 | Dunn et al. | 4/585 |

FOREIGN PATENT DOCUMENTS

| | | | |
|---|---|---|---|
| 12475 | 2/1905 | Fed. Rep. of Germany | 4/159 |
| 205368 | 9/1939 | Switzerland | 4/520 |
| 16875 | of 1897 | United Kingdom . | |

*Primary Examiner*—Henry J. Recla
*Assistant Examiner*—Keith Kupferschmid
*Attorney, Agent, or Firm*—Juettner Plye & Lloyd

[57] ABSTRACT

A bathing device comprises an air inflatable bathtub and shampoo bowl of flexible material. When deflated, the bathing device lies flat for convenient storage and portability. When inflated, it expands to form a bathtub in which a person may sit, a sloped backrest against which the person may lean and a shampoo bowl behind the backrest for receiving water used to shampoo and person's hair. Drains are provided for draining water from the bathtub and shampoo bowl upon completion of bathing. A bathing device also comprises an air inflatable shampoo cap of flexible material, which when deflated folds flat. When inflated, the shampoo cap fits and seals with the head of a person to accommodate shampooing the person's hair while confining wash water to the cap. The shampoo cap may be used separately from or together with the shampoo bowl and bathtub, and if desired it may be an integral part of the same.

19 Claims, 3 Drawing Sheets

INFLATABLE BATHING DEVICES

This application is a continuation-in-part of Ser. No. 357,018 filed May 24, 1989 and now abandoned.

BACKGROUND OF THE INVENTION

The present invention relates to bathing devices in general, and in particular to portable and air inflatable bathing devices that are particularly adapted for use with disabled and incapacitated persons, such as those who are sick and/or elderly.

It is often difficult for a disabled person to bathe. Transporting the person to a bathtub may be difficult, and it may be hard for the person to enter and remain properly seated in the bathtub. Also, since the person may not be in full physical control of himself, a danger exists that he may slip and fall when entering the bathtub and be injured.

It sometimes happens that a disabled person, such as a patient in a hospital or nursing home, simply requires a shampoo without a complete bath. Usually, there are only two choices available for washing the person's hair. One is to bring the person to a sink over which he may lean for being shampooed, but that can be difficult depending upon the physical condition of the person. The other is for the person to get into a bathtub, but that gives rise to the above mentioned problems.

OBJECTS OF THE INVENTION

An object of the present invention is to provide a portable and air inflatable bathing device, which includes a bathtub that may conveniently be brought to and used by a disabled person.

Another object is to provide such a bathing device which, when deflated, is flat for storage and may easily be placed beneath the person and then inflated to an expanded condition around the person.

A further object is to provide such a bathing device, the bathtub of which has a backrest for supporting the person during bathing.

Yet another object is to provide such a bathing device, which has a shampoo bowl rearwardly of the backrest for collecting water used to wash the person's hair.

Still another object is to provide a bathing device that comprises an inflatable shampoo cap that fits the head of a person to accommodate washing of only the person's hair.

A still further object is to provide such a shampoo cap, which may be used either alone or together with the inflatable bathtub and shampoo bowl and which, if desired, may be an integral part of the bathtub and shampoo bowl.

SUMMARY OF THE INVENTION

According to the present invention, an air inflatable bathing device comprises integrally connected inflatable walls of flexible material forming a bathtub and shampoo bowl. The walls include a bottom wall, side wall means connected to and extending upwardly from around the periphery of the bottom wall to form a tub-shaped enclosure therewith, and a backrest wall connected to the bottom wall and side wall means and separating the tub-shaped enclosure into a bathtub on one side of the backrest wall and a shampoo bowl on the opposite side. Air valve means are provided for inflating the bathing device to form the bathtub and shampoo bowl and for deflating the bathing device to lie flat.

Preferably, the backrest wall is curved at its upper end to define a neckrest for a person in the bathtub. The bathtub receives and contains water for bathing the person and the shampoo bowl receives and contains water used to shampoo the person's hair, and first and second valve means respectively drain water from the bathtub and shampoo bowl. Hose means conveys water from the valve means to a point of discharge.

The bathing device includes an inflatable shampoo cap of flexible material. The shampoo cap comprises an inflatable upstanding upper wall defining a basin for generally surrounding the top of a person's head, and the basin has open upper, lower and rearward ends to expose and provide access to the person's hair for shampooing. A runoff water guide extends downwardly from the open rearward end of the basin for receiving and conveying away wash water flowing out of the basin, and means are provided for generally sealingly attaching the shampoo cap to the person's head. An air valve means is connected to the shampoo cap for inflating the basin and runoff water guide and for deflating the same to lie flat. The shampoo cap may be connected to an upper end of the backrest wall.

The invention also contemplates a bathing device that comprises an air inflatable shampoo cap of flexible material, which shampoo cap includes an inflatable upstanding upper wall defining a basin for generally surrounding the top of a person's head. The basin has open upper, lower and rearward ends to expose and provide access to the person's hair for shampooing, and an inflatable runoff water guide extends downwardly from the open rearward end of the basin for receiving and conveying away wash water flowing out of the basin. Means are provided for generally sealingly attaching the shampoo cap to the person's head, and the basin prevents water used to shampoo the person's hair from otherwise wetting the person. Air valve means are included for inflating the basin and runoff water guide and for deflating the same to be flat.

The shampoo cap is advantageously an integral structure, and in one embodiment the runoff water guide is an inflatable channel extending downwardly from the open rearward end of the basin. In another embodiment, the runoff water guide comprises an inflatable bowl having an open upper end for receiving wash water flowing out of the open rearward end of the basin. An opening in the lower end of the bowl permits water to flow out of the bowl, and a hose connected to the opening conveys the water to a point of discharge. The shampoo cap may be used with a person in a wheelchair, and includes a pocket for receiving the upper end of the wheelchair backrest to support the shampoo cap on the wheelchair, along with belt means that extends around the wheelchair back for further attaching the shampoo cap to the wheelchair.

The foregoing and other objects, advantages and features of the invention will become apparent upon a consideration of the following detailed description, when taken in conjunction with the accompanying drawings.

DETAILED DESCRIPTION

Figure 1:
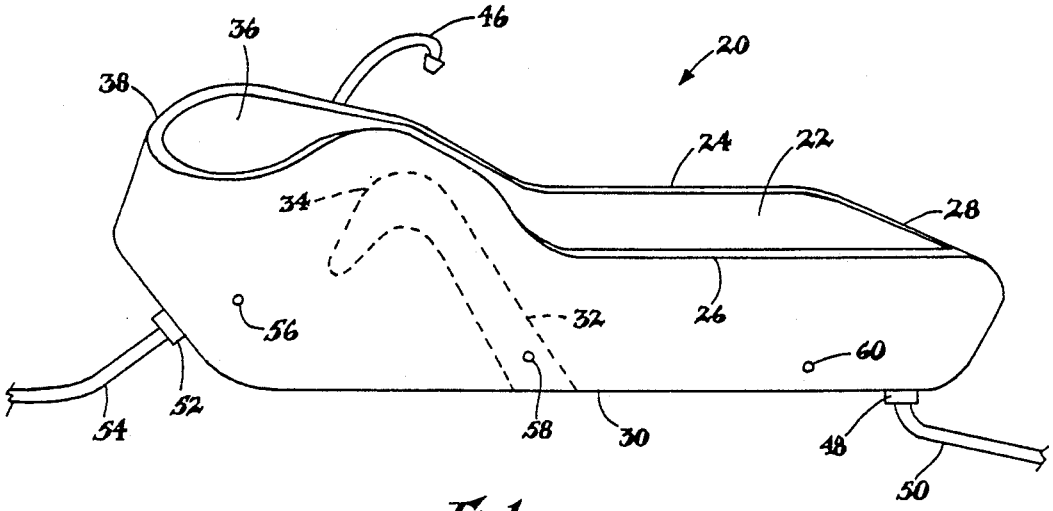
FIG. 1 is a perspective view of one embodiment of inflatable bathing device, comprising an integral bathtub and shampoo bowl.
Figure 2:
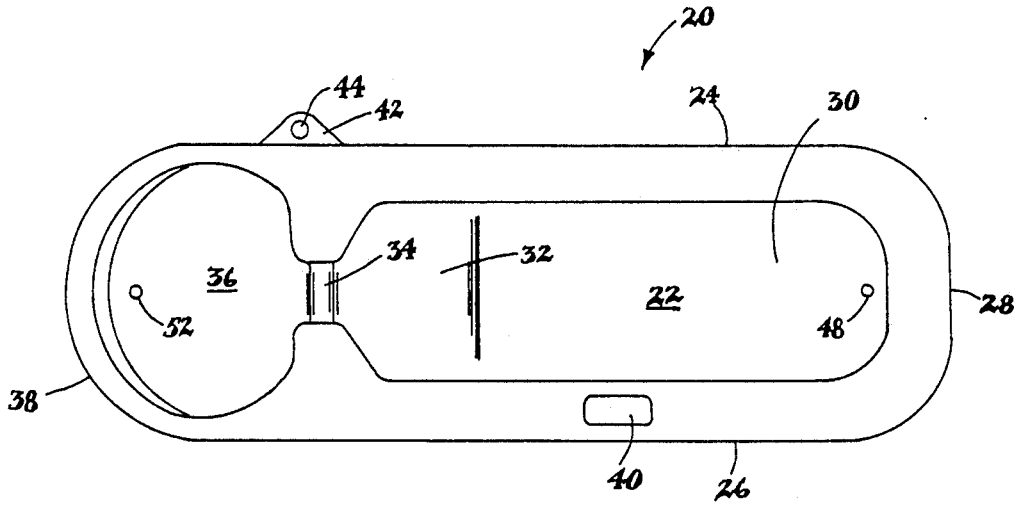
FIG. 2 is a top plan view of the bathing device of FIG. 1.

FIGS. 1 and 2 illustrate an air inflatable bathing device, indicated generally at 20, according to one embodiment of the invention. The bathing device is of integral construction and made of layers of a flexible, waterproof and airtight material, such as of vinyl or plastic. The bathing device is specially configured to facilitate bathing and/or shampooing a disabled or incapacitated person, such as someone who is sick or elderly.

The bathing device 20 is shown in its inflated and expanded state, and as such includes a bathtub 22 defined by inflatable side walls 24 and 26, an inflatable end wall 28, an inflatable bottom wall 30 and an inflatable backrest wall 32. The backrest wall extends across the bottom wall and between the side walls, and is sealed to the side walls and bottom wall. The backrest wall also is sloped rearwardly to provide comfortable support for the back of the person being bathed, and is curved over and downwardly at its upper end to define a neckrest 34.

Rearwardly of the bathtub 22 and backrest wall 32 there is a shampoo bowl 36, defined by an inflatable curved wall 38, the backrest wall and the bottom wall 30 which serves both the bathtub and shampoo bowl. In the alternative, the side walls 24 and 26 may be extended rearwardly of the backrest wall and curved together to define, along with the bottom wall, the shampoo bowl. The purpose of the shampoo bowl is to collect and contain water used in shampooing the person's hair.

A pocket or receptacle 40 for holding soap is in the side wall 26, and an extension 42, having an opening 44, is on the side wall 24. The extension supports, within its opening, a wash water sprayer 46 that connects through a hose to a supply of water (neither shown). To enable draining of water that collects in the bathtub 22 and shampoo bowl 36, the bathtub has a water drain valve 48 and a drain hose 50 and the shampoo bowl has a water drain valve 52 and a drain hose 54. The drain hoses may lead to any suitable and convenient discharge point, such as to a toilet, a conventional bathtub or a container.

The bathing device 20 is inflated with air, and for the purpose includes one or more air valves, three of which are shown as 56, 58 and 60. The valve 56 is for inflating the curved wall 38 of the shampoo bowl 36, the valve 58 is for inflating the backrest wall 32 and its neckrest 34, and the valve 60 is for inflating the side walls 24 and 26, the end wall 28 and the bottom wall 30, which bottom wall serves both the bathtub and shampoo bowl. However, more or fewer air valves could be used, depending upon the degree of control desired in inflating and configuring the bathing device and the separation or interconnection of the air pockets defined within the various walls. For example, if all of the wall air pockets were separate, six air valves could be used, one for each of the side walls 24 and 26, the end wall 28, the bottom wall 30, the backrest wall 32 and its neckrest 34, and the curved wall 38. For convenient inflation of the bathing device, a foot operated air pump may be used.

The bathing device 20 can be inflated prior to entry of the person to be bathed into the bathtub 22. In the alternative, if the physical condition of the person necessitates, it can initially be deflated and flat so that it can easily be slipped under the person, which is particularly advantageous if the person is confined to bed. Once under the person, the bathing device may then be inflated and expanded around the person such that, when fully inflated, the person is in the bathtub 22 with his back against the backrest wall 32. The person may then be bathed and rinsed using the water sprayer 46 and soap from the receptacle 40. If desired, with the back of the person's neck supported by the neckrest 34 so that his hair is over the shampoo bowl 36, his hair may then be washed and rinsed with the sprayer, with the wash and rinse water flowing into the shampoo bowl. After bathing and shampooing, the valves 48 and 52 are opened to drain the water from the bathtub and shampoo bowl. At this point, if the person cannot lift himself or be lifted out of the bathtub, the bathing device may be deflated to its flat condition and slipped from beneath him.

Figure 3:
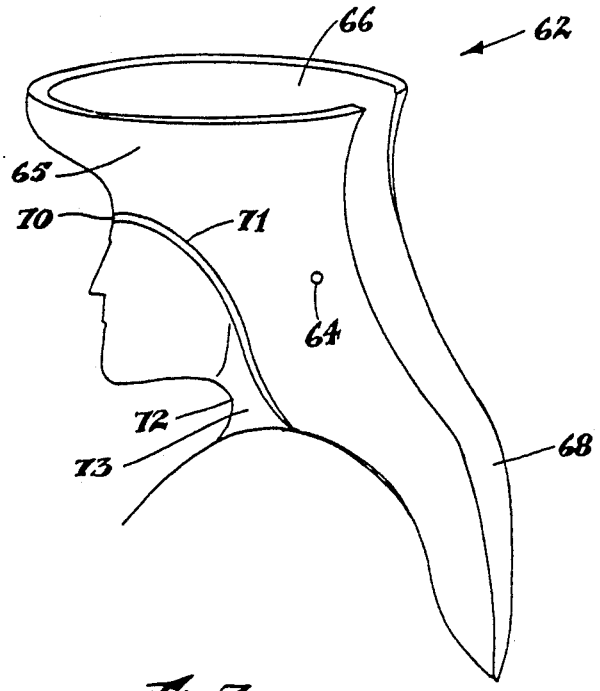
FIG. 3 is a perspective view of another embodiment of bathing device, comprising an inflatable shampoo cap.
Figure 5:
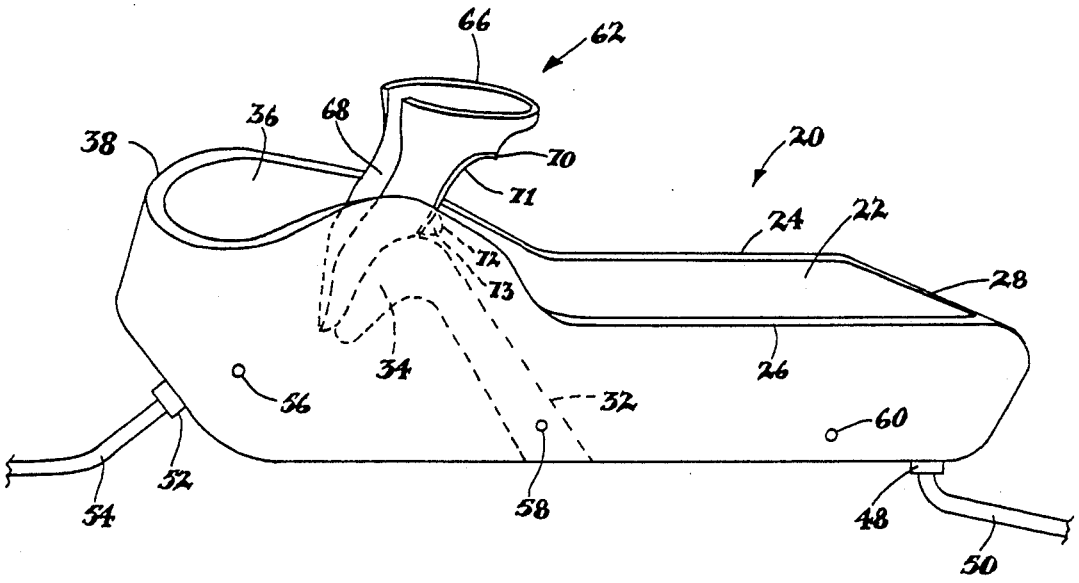
FIG. 5 is a perspective view of a combination of the bathing device of FIG. 1 and shampoo cap of FIG. 3.

Although the bathing device 20 may be used solely to shampoo the person's hair, for convenience in simply shampooing hair, the invention also contemplates an inflatable shampoo cap, indicated generally at 62 in FIG. 3. The shampoo cap is also made of layers of a flexible, waterproof and airtight material, such as of vinyl or plastic, and is inflated by means of an air valve 64. It includes an upstanding upper wall 65 defining a basin 66, and a lower runoff water guide 68 extends downwardly from the basin. The upper, lower and rearward ends of the basin are open to expose the person's hair, and the shampoo cap is placed on and generally sealed with the person's head by means of Velcro straps 70 at the forehead and Velcro straps 72 at the neck. While shown in side view, it is understood that the shampoo cap is symmetrical to its opposite sides, and the cap has a seam 71 extending generally around the lower periphery of the wall 65, which seam is provided with a slit or separation (not shown) at the front of the cap. The cap also has a pair of neckflaps, one on each of its sides, only a neckflap 73 being shown. The Velcro straps 70 are connected to the seam 71 on opposite sides of the separation in the seam, the Velcro straps 72 are connected to respective ones of the neckflaps, and the Velcro straps are drawn together and attached to hold the seam generally sealingly against the person's head. During shampooing, the basin prevents spattering of water and keeps water off of the person and surroundings, with runoff water that exits the open rearward end of basin flowing down the runoff guide for collection in a container (not shown). The shampoo cap may be used in combination with the bathing device 20, as shown in FIG. 5. It may also, again as shown in FIG. 5, be made an integral part of the bathing device, for example by adhesively attaching the runoff water guide 68 to the neckrest 34, such that the shampoo cap can fall back into the shampoo bowl 36 when it is deflated.

Figure 4:
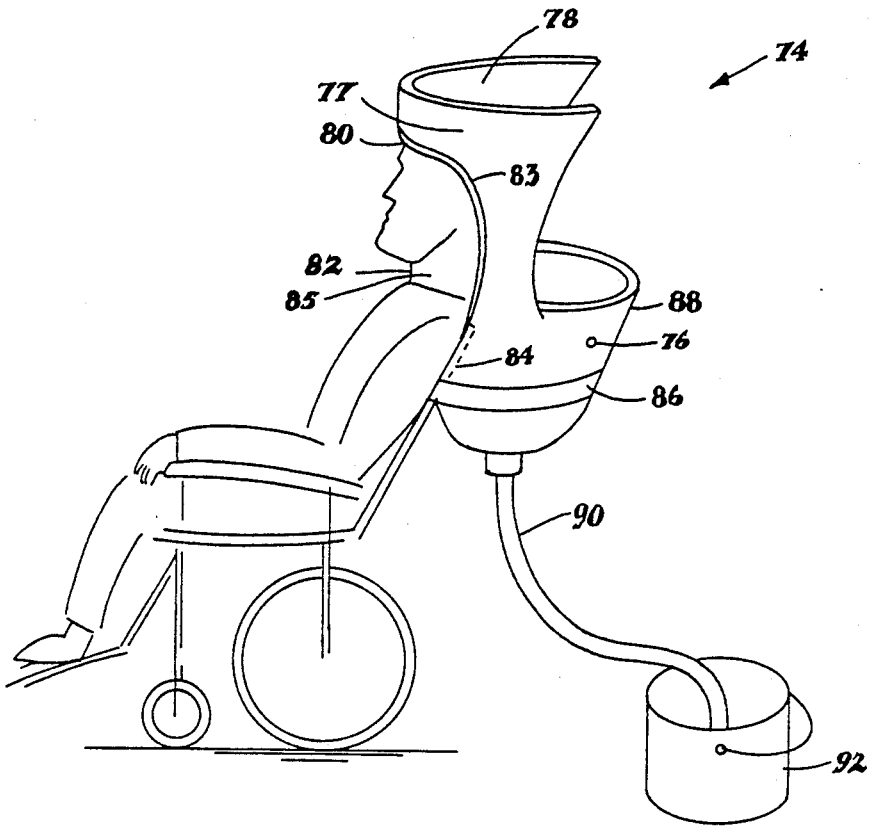
FIG. 4 is a perspective view of a further embodiment of inflatable shampoo cap.

FIG. 4 illustrates another embodiment of inflatable shampoo cap, indicated generally at 74, which is particularly adapted for use with a person in a wheelchair. The shampoo cap is made of layers of a flexible material, and when inflated by means of an air valve 76 has an upstanding upper wall 77 defining a basin 78, the upper, lower and rearward ends of which basin are open to expose the person's hair. The shampoo cap is placed on and sealed to the person's head by means of Velcro straps 80 and 82 at the forehead and neck. While shown in side view, it is understood that the shampoo cap 74 is symmetrical to its opposite sides, and the cap has a seam 83 extending generally around the lower periphery of the wall 77, which seam is provided with a slit or separation (not shown) at the front of the cap. The cap also has a pair of neckflaps, one on each of its sides, only a neckflap 85 being shown. The Velcro straps 80 are connected to the seam 83 on opposite sides of the separation in the seam, the Velcro straps 82 are connected to respective ones of the neckflaps, and the Velcro straps are drawn together and attached to hold the seam generally sealingly against the person's head. The shampoo cap may be supported on the back of the wheelchair by means of a pocket 84 in the cap that receives the upper end of the wheelchair back and/or by a belt 86 that extends around the back. To collect water flowing out of the basin, the lower end of the shower cap defines an inflatable bowl 88 that is open at its upper end and has an opening at its lower end from which water flows through a hose 90 to a container 92.

The invention thus provides improved bathing devices for use in bathing and/or shampooing disabled and incapacitated people who cannot for one reason or another conveniently use a conventional bathtub. Because the devices are deflatable to a flat condition, they are quite portable and may easily be carried from one person to another for use. Of advantage is the flat condition of the bathing device 20 when deflated, which permits it to be slipped beneath a person who cannot otherwise be moved and then inflated to surround the person. When inflated, the side walls 24 and 26, end wall 28, bottom wall 30 and backrest 32 provide comfortable support for the person being bathed, yet at the same time contain water used during bathing.

While embodiments of the invention have been described in detail, various modifications and other embodiments thereof may be devised by one skilled in the art without departing from the spirit and scope of the invention, as defined in the appended claims.

What is claimed is:

1. In combination, an air inflatable bathing device and a shampoo cap, said bathing device comprising integrally connected inflatable walls of flexible material forming a bathtub and shampoo bowl, said walls including an inflatable bottom wall, inflatable side wall means connected to and extending upwardly from around the periphery of said bottom wall to form a tub-shaped enclosure therewith, and an inflatable backrest wall connected to said bottom wall and side wall means and separating said tub-shaped enclosure into a bathtub on one side of said backrest wall and a shampoo bowl on the opposite side; and air valve means for inflating said bathing device to form said bathtub and shampoo bowl and for deflating said bathing device to lie flat, said shampoo cap comprising an integral and air inflatable shampoo cap of flexible material including an inflatable upstanding upper wall defining a basin for generally surrounding the top of a person's head, said basin having open upper, lower and rearward ends to expose and provide access to the person's hair for shampooing; an inflatable runoff water guide extending downwardly from said open rearward end of said basin for receiving and conveying wash water away from said basin; means for generally sealingly attaching said shampoo cap to the person's head; and air valve means for inflating said basin and runoff water guide to form said shampoo cap and for deflating the same to lie flat.

2. The combination as in claim 1, wherein said backrest wall is inclined from bottom to top toward said shampoo bowl.

3. The combination as in claim 1, wherein said backrest wall is curved at its upper end to define a neckrest for a person in said bathtub.

4. The combination as in claim 1, wherein said bathtub receives and contains water used to bathe a person therein and said shampoo bowl receives and contains water used to shampoo the person's hair, and including first and second valve means for respectively draining water from said bathtub and shampoo bowl.

5. The combination as in claim 4, including hose means, connected to said first and second valve means, for conveying drained water to a point of discharge.

6. The combination as in claim 1, including a soap receptacle in said side wall means.

7. The combination as in claim 1, including a holder on said side wall means for supporting a water sprayer for bathing and shampooing a person.

8. The combination as in claim 1, wherein said side wall means comprises an end wall of said bathtub, first and second side walls on opposite sides of said bottom wall and extending between said end wall and said backrest wall, and a shampoo bowl wall connected to said bottom wall behind said backrest wall and extending at opposite ends to said first and second side walls.

9. The combination as in claim 8, wherein said air valve means comprises a plurality of air valves, each connected to one of said bottom, side, end, shampoo bowl and backrest walls.

10. The combination as in claim 1, wherein said bathing device, when deflated and flat, is adapted to be placed beneath a person to be bathed and to then be inflated to form said bathtub and shampoo bowl with said bathtub being formed around the person.

11. An inflatable bathing device, comprising integrally connected inflatable walls of flexible material forming a bathtub and shampoo bowl, said walls including a bottom wall, side wall means connected to and extending upwardly from around the periphery of said bottom wall to form a tub-shaped enclosure therewith, and a backrest wall connected to said bottom wall and side wall means and separating said tub-shaped enclosure into a bathtub on one side of said backrest wall and a shampoo bowl on the opposite side; and air valve means for inflating said bathing device to form said bathtub and shampoo bowl and for deflating said bathing device to lie flat, and including an integral and air inflatable shampoo cap of flexible material, said shampoo cap comprising an inflatable upstanding upper wall defining a basin for generally surrounding the top of a person's head, said basin having open upper, lower and rearward ends to expose and provide access to the person's hair for shampooing; a runoff water guide extending downwardly from said open rearward end of said basin for receiving and conveying wash water away from said basin; means for generally sealingly attaching said shampoo cap to the person's head; and air valve means for inflating said basin and runoff water guide to form said shampoo cap and for deflating the same to lie flat, wherein said shampoo cap is connected to an upper end of said backrest wall and is integral with said bathing device.

12. An inflatable bathing device, comprising an air inflatable shampoo cap of flexible material, said shampoo cap including an inflatable upstanding upper wall defining a basin for generally surrounding the top of a person's head, said basin having open upper, lower and rearward ends to expose and provide access to the person's hair for shampooing; an inflatable runoff water guide extending downwardly from said open rearward end of said basin for receiving wash water flowing out of said open rearward end and conveying the water away from said basin; means for generally sealingly attaching said shampoo cap to the person's head, said basin preventing water used to shampoo the person's hair from spattering and wetting the person; and air valve means for inflating said basin and runoff water guide to form said shampoo cap and for deflating the same to be flat.

13. An inflatable bathing device as in claim 12, wherein said runoff water guide comprises an inflatable channel extending downwardly from said open rearward end of said basin.

14. An inflatable bathing device as in claim 12, wherein said shampoo cap comprises an integral structure.

15. An inflatable bathing device as in claim 12, wherein said runoff water guide comprises an inflatable bowl having an open upper end for receiving wash water flowing out of said open rearward end of said basin.

16. An inflatable bathing device as in claim 15, wherein said bowl has an opening in its lower end for a flow of water out of said bowl.

17. An inflatable bathing device as in claim 16, including a hose connected to said bowl opening for conveying water flowing from said opening to a point of discharge.

18. An inflatable bathing device as in claim 12, wherein said shampoo cap is for use with a person in a wheelchair and includes a pocket for receiving an upper end of a back of the wheelchair to support said shampoo cap on the wheelchair back.

19. An inflatable bathing device as in claim 18, including belt means extendable around said shampoo cap and the back of the wheelchair for attaching said shampoo cap to the wheelchair.

* * * * *